US006332450B1

(12) United States Patent
Muto et al.

(10) Patent No.: US 6,332,450 B1
(45) Date of Patent: Dec. 25, 2001

(54) THROTTLE CONTROL APPARATUS OF INTERNAL COMBUSTION ENGINE AND THROTTLE CONTROL METHOD

(75) Inventors: Harufumi Muto, Nishikamo-gun; Kei Masuda, Toyota; Makoto Fujita, Nishikamo-gun; Naoto Kushi, Okazaki, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/577,831

(22) Filed: May 25, 2000

(30) Foreign Application Priority Data

Jun. 7, 1999 (JP) ..... 11-159396

(51) Int. Cl.[7] ..... F02D 9/02; F02D 11/10; F02D 41/04

(52) U.S. Cl. ..... 123/352; 123/361; 701/110

(58) Field of Search ..... 123/352, 361, 123/399; 180/179; 701/110

(56) References Cited

U.S. PATENT DOCUMENTS 4,541,052 * 9/1985 McCulloch ..... 123/399 X
5,069,181 12/1991 Togai et al. ..... 123/399
6,078,860 * 6/2000 Kerns ..... 123/399 X

FOREIGN PATENT DOCUMENTS

A 61-93250 5/1986 (JP) .
A 63-140837 6/1988 (JP) .
A 1-117967 5/1989 (JP) .
A 1-117968 5/1989 (JP) .
A-9-42032 2/1997 (JP) .
A 9-160657 6/1997 (JP) .
A 9-254678 9/1997 (JP) .

* cited by examiner

*Primary Examiner*—Tony M. Argenbright
(74) *Attorney, Agent, or Firm*—Oliff & Berridge PLC

(57) ABSTRACT

In a throttle control apparatus of an internal combustion engine, when the driver operates an accelerator so as to cause a motor vehicle to proceed to a steady-state running mode, a target throttle opening amount is no longer controlled to a throttle opening amount that depends upon an operated amount of the accelerator. Instead, the throttle opening amount is controlled to a value that provides a steady-state required torque. In this manner, the vehicle is immediately brought into a desired steady-state running mode, without requiring the driver to repeatedly operate the accelerator since the accelerator operation is not directly reflected by the throttle opening amount. Thus, the driver need not frequently repeat accelerator operations when the vehicle enters a steady-state running mode, thus assuring improved driveability.

27 Claims, 7 Drawing Sheets

SPD t0
t1
t2
TIME
tTA, TAR/L
TAR/L tTA
t0
t1
t2
TIME
ttTA t0
t1
t2
TIME

STEADY-STATE REQUEST FLAG
ON
OFF

SPD t10
t12
TIME
tTA, TAR/L
TAR/L tTA
t10
t12
TIME
ttTA t10
t11
t12
TIME

STEADY-STATE REQUEST FLAG
ON
OFF

THROTTLE CONTROL APPARATUS OF INTERNAL COMBUSTION ENGINE AND THROTTLE CONTROL METHOD

INCORPORATION BY REFERENCE

The disclosure of Japanese Patent Application No. 11-159396 filed on Jun. 7, 1999 including the specification, drawings and abstract is incorporated herein by reference in its entirety.

BACKGROUND OF THE INVENTION

1. Field of the Invention

The invention relates to a throttle control apparatus of an internal combustion engine which operates to control a throttle valve so that the throttle opening amount matches a target throttle opening amount that depends upon an accelerator operated amount (i.e., an amount of depression of an accelerator pedal), and also relates to a throttle control method.

2. Description of Related Art

A known throttle control apparatus, as disclosed in Japanese Laid-open Patent Publication No. 9-42032, operates to appropriately control the throttle opening amount depending upon operating conditions of the engine as well as a driver's demand, by electronically controlling the throttle valve of the engine mounted in an automobile, or the like. In the throttle control apparatus, the output torque of the engine is controlled in response to a driver's demand in the following manner.

A target throttle opening amount is calculated based on an accelerator operated amount, i.e., an amount of depression of the accelerator pedal, and the opening amount of the throttle valve (throttle opening amount) is controlled to be substantially equal to the target throttle opening amount by means of an electric motor, or the like.

Under the above-described throttle opening amount control, the throttle opening amount increases or decreases with increases or decreases in the accelerator operated amount when the driver accelerates or decelerates the automobile, and therefore good driveability can be obtained without any problem. When the driver attempts to start more stable running of the vehicle in a steady-state operating mode upon completion of the acceleration or deceleration, however, the running conditions are not immediately stabilized, and the accelerator needs to be frequently operated in a repeated manner, with a result of deteriorated driveability.

Immediately after the accelerator operated amount undergoes a great change for acceleration or deceleration, for example, the throttle opening amount largely changes toward a target throttle opening amount that is set depending upon the accelerator operated amount, and the engine itself is also in the middle of transition from one operating state to another. It is therefore difficult to operate the accelerator pedal to such an accelerator pedal position that corresponds to a desired output torque so that the output torque is controlled to the desired level. Accordingly, the driver must frequently or repeatedly operate the accelerator pedal after the accelerating or decelerating operation, and thus sufficiently good driveability cannot be attained.

In the device disclosed in Japanese Laid-open Patent Publication No. 9-42032, when variations in the accelerator operated amount (the amount of depression of the accelerator pedal by the driver) are reduced, the control gain of the throttle opening amount is reduced based on the assumption that the automobile has been brought into a steady-state running mode, to thereby realize stable steady-state running of the automobile. However, the variations in the accelerator operated amount are reduced only after the running conditions of the automobile are sufficiently stabilized. In other words, the accelerator operated amount is still varied by a large degree during the transition from an accelerating/decelerating mode to the steady-state running mode. Thus, the throttle opening amount control cannot be started until after the accelerator operated amount is stabilized, and therefore the driveability cannot be improved.

SUMMARY OF THE INVENTION

It is therefore an object of the invention to provide a throttle control apparatus of an internal combustion engine which eliminates the need for the driver to frequently operate the accelerator pedal before the vehicle attains a steady-state running mode, and to thereby improve the driveability of the vehicle.

To accomplish the above and/or other objects, a throttle control apparatus of an internal combustion engine according to a first aspect of the invention includes a control system that controls a throttle valve so that an output torque of the engine matches a steady-state required torque calculated for realizing a steady-state operating state, when an accelerator is operated so as to bring the engine into a steady-state operating mode.

When the operation performed on the engine is intended to bring the engine into a steady-state operating mode, the throttle opening amount is controlled so as to provide a steady-state required torque calculated for realizing a steady-state operating state, instead of being controlled depending upon the accelerator operated amount (i.e., the amount of depression of the accelerator pedal).

Thus, when the engine is operated so as to proceed to a steady-state operating mode, the throttle opening amount does not directly depend upon accelerator operations or manipulation, but is controlled so as to provide the steady-state required output torque. Even when the accelerator pedal is operated so as to bring the engine into a steady-state operating mode, the throttle opening amount no longer directly depends upon the accelerator operation if it is judged as being directed to the steady-state operating mode, and the throttle opening amount is controlled to the steady-state required torque. This prevents the throttle opening amount from rapidly changing in accordance with the accelerator operated amount.

Accordingly, the operating state of the engine immediately proceeds or switches over to a desired steady-state operating mode, and the driver does not need to repeatedly operate the accelerator since the accelerator operation is not used at that time to control the throttle opening amount. This leads to enhanced driveability.

The control system according to the first aspect of the invention may operate to control the throttle valve so that the output torque of the engine matches the steady-state required torque calculated for realizing a steady-state operating state as long as the engine continues to operate in a steady-state operating mode after the operation performed on the engine is judged as being intended to bring the engine into a steady-state running mode.

According to a second aspect of the invention, a throttle control apparatus of an internal combustion engine is provided which includes a throttle controller. The controller detects running conditions of a drive mechanism that is driven by the engine, and calculates a steady-state required torque based on the detected running conditions of the driven mechanism, the steady-state required torque being a torque that is required for bringing the driven mechanism into a steady-state running mode, and determines whether an operation performed on the engine causes the driven mechanism to proceed to the steady-state running mode, and controls a throttle valve so that an output torque of the engine matches the calculated steady-state required torque when it is determined that the operation performed on the engine causes the driven mechanism to proceed to the steady-state running mode.

As described above, when the controller determines that the operation performed on the engine causes the driven mechanism to proceed to the steady-state running mode, and controls a throttle valve so that the output torque of the engine matches the calculated steady-state required torque. If the operation performed on the engine (i.e., accelerator operation) is judged as being intended to bring the driven mechanism into the steady-state running mode, therefore, the throttle opening amount can be controlled such that the detected running conditions of the driven mechanism are made constant or stable.

Accordingly, if the driver performs an operation to proceed to steady-state running, the running conditions at that time are regarded as the steady-state running conditions. Then, the throttle opening amount is controlled so as to maintain the steady-state running conditions, without further dependence upon the accelerator operated amount. With this arrangement, the throttle opening amount is prevented from being rapidly changed in accordance with the accelerator operated amount. Consequently, the driven mechanism immediately proceeds to the desired steady-state running mode, without requiring the driver to repeatedly operate the accelerator pedal, thus assuring improved driveability.

The control system according to the second aspect of the invention may operate to control the throttle valve so that the output torque of the engine matches the steady-state required torque calculated for realizing a steady-state operating state, as long as the engine continues to operate in a steady-state operating mode after the operation performed on the engine is judged as being intended to bring the engine into a steady-state running mode.

In the throttle control apparatus of the engine according to the second aspect of the present invention, the controller may calculate a demanded output torque based on an operation performed on the engine, and determine that the operation performed on the engine causes the driven mechanism to proceed to a steady-state running mode, under a first condition that a difference between the demanded output torque and the calculated steady-state required torque is equal to or smaller than a first predetermined value.

For example, the controller may calculate a demanded output torque based on the operation performed on the engine, and determine that the operation performed on the engine is intended to bring the driven mechanism to proceed to a steady-state running mode under such a condition that a difference between the demanded output torque and the steady-state required torque calculated by the steady-state required torque calculator is reduced to or below a certain minimum value.

With the above determination made, the operation performed on the engine can be detected as being an operation for bringing the driven mechanism into steady-state running.

In the throttle control apparatus according to the second aspect of the invention, the controller may calculate a change in an amount of the operation performed on the engine, and determine that the operation performed on the engine causes the driven mechanism to proceed to a steady-state running mode, under a second condition that the change in the mount of the operation performed on the engine is larger than a second predetermined value, in addition to the first condition.

As described above, the condition that a change in the amount of the operation performed on the engine is larger than a certain value, in addition to the first condition, must be satisfied so as to determine that the operation performed on the engine is intended to bring the driven mechanism into a steady-state running mode. Thus, the operation to proceed to steady-state running can be detected with higher accuracy, and more accurate control can be performed.

Furthermore, the controller may determine that the operation performed on the engine causes the driven mechanism to proceed to a steady-state running mode, under a third condition that the driven mechanism was in an accelerating or decelerating state at a point in time immediately before the current control cycle, in addition to the above-described conditions.

Thus, the condition that the driven mechanism was in an accelerating or decelerating state at a point in time immediately before the current control cycle, in addition to the first and second conditions, must be satisfied so as to determine that the operation performed on the engine is intended to bring the driven mechanism into a steady-state running mode. With this arrangement, the operation to proceed to steady-state running can be detected with higher accuracy, and more accurate control can be performed.

Also, the controller determines that the driven mechanism was in an accelerating or decelerating state at the point in time immediately before the current control cycle when a difference between the output torque of the engine and the calculated steady-state required torque was equal to or larger than a third predetermined value at the point in time immediately before the current control cycle.

It can be determined that the driven mechanism was in an accelerating or decelerating state at a point in time immediately before the current cycle, on the basis of the fact that a large difference existed between the output torque of the engine and the steady-state required torque until the point immediately before the current control cycle.

In the throttle control apparatus according to the second aspect of the invention, the controller may be provided for determining that the engine is operated so as to release the driven mechanism from the steady-state running mode. This state is determined when a difference between the demanded output torque calculated based on the operation performed on the engine and the calculated steady-state required torque is larger than the first predetermined value. The controller then causes switching over to throttle control under which the throttle opening amount is controlled to a target throttle opening amount that depends upon an accelerator operated amount.

Thus, the controller determines that the driven mechanism leaves or comes out of the steady-state running mode when a difference between the demanded output torque and the steady-state required torque becomes larger than a certain value. Upon completion of steady-state running, the controller transfers or switches over to throttle control under which the throttle opening amount is controlled to a target throttle opening amount that depends upon or varies with the accelerator operated amount.

When the driver operates the accelerator pedal for acceleration or deceleration, therefore, the driven mechanism promptly leaves the steady-state running mode, and can be accelerated or decelerated with high response. Thus, good driveability can be maintained even in decelerating operations.

In the throttle control apparatus of the engine according to the first or second aspects of the invention, the control may be provided so as to gradually change a target throttle opening amount so as to provide the steady-state required torque, to a target throttle opening amount that depends upon the accelerator operated amount, when the driven mechanism shifts from the steady-state running mode to a non-steady-state running mode.

When the driven mechanism leaves a steady-state running mode, the target throttle opening amount is gradually changed from an amount that is set so as to provide a steady-state required torque, to an amount that depends upon the accelerator operated amount (i.e., the amount of depression of the accelerator pedal). This makes it possible to suppress shocks due to variations in the output torque upon switching of control, and maintain further improved driveability.

According to another aspect of the invention, a throttle control method of an internal combustion engine includes the steps of: detecting running conditions of a driven mechanism that is driven by the engine; calculating a steady-state required torque based on the running conditions of the driven mechanism, the steady-state required torque being required to bring the driven mechanism into a steady-state running mode; determining whether an accelerator operation performed on the engine causes the driven mechanism to proceed to the steady-state running mode; and controlling a throttle valve so that an output torque of the engine matches the calculated steady-state required torque when it is determined that the accelerator operation performed on the engine causes the driven mechanism to proceed to the steady-state running mode.

BRIEF DESCRIPTION OF THE DRAWINGS

The foregoing and other objects, features and advantages of the invention will become apparent from the following description of preferred embodiments with reference to the accompanying drawings in which.

DETAILED DESCRIPTION OF PREFERRED EMBODIMENTS

Figure 1:
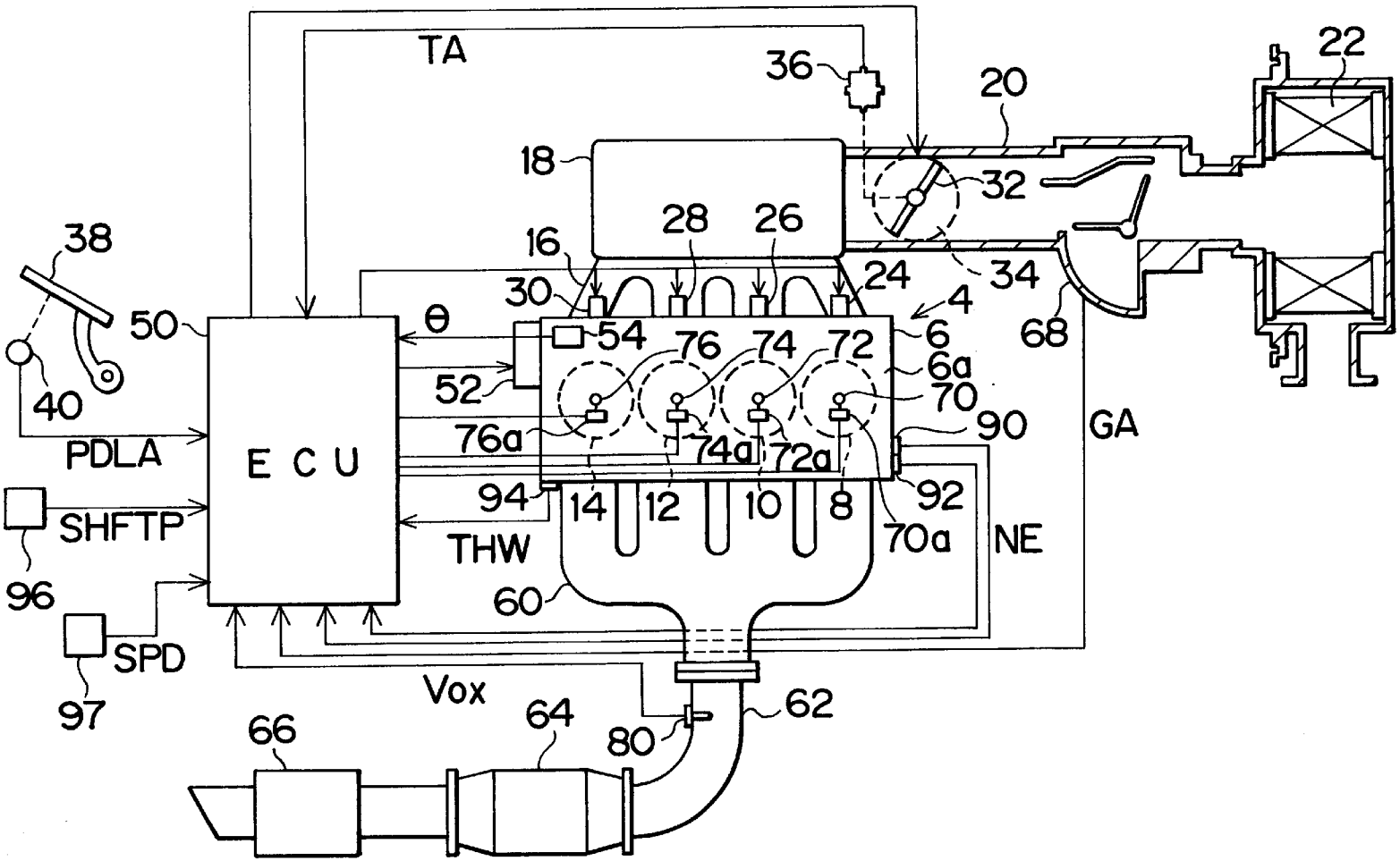
FIG. 1 is a block diagram schematically showing the construction of a gasoline engine and its control system according to a first embodiment of the invention.

FIG. 1 is a block diagram schematically showing the construction of a gasoline engine (which will be simply called "engine") 4 and its control system to which the invention is applied. The engine 4 is mounted in an automobile for running/driving the automobile as a driven mechanism.

The engine 4 includes a cylinder block 6 in which first cylinder 8, second cylinder 10, third cylinder 12 and fourth cylinder 14, each having a combustion chamber, are formed. An intake passage 20 is connected to each of the cylinders 8, 10, 12, 14, via an intake manifold 16 and a surge tank 18. An air cleaner 22 is provided on the upstream side of the intake passage 20, and ambient air is introduced into the intake passage 20 through the air cleaner 22.

Fuel injectors 24, 26, 28, 30 corresponding to the respective cylinders 8, 10, 12, 14 are provided in the intake manifold 16. The fuel injectors 24, 26, 28, 30 are solenoid-operated valves that are driven to be opened or closed with controlled current applied thereto, and serve to jet or eject fuel that is carried under pressure from a fuel tank (not shown) by means of a fuel pump (not shown). The fuel ejected from the injectors 24, 26, 28, 30 is mixed with intake air in the intake manifold 16, to provide an air/fuel mixture. The air/fuel mixture is introduced into the combustion chamber of each of the cylinders 8, 10, 12, 14, through a corresponding intake port (not shown) that is opened when an intake valve (not shown) provided for each cylinder 8, 10, 12, 14 is opened. Under air/fuel ratio feedback control, the length of fuel injection time (duration of fuel injection) of the fuel injectors 24, 26, 28, 30 is controlled based on an air/fuel ratio feedback correction factor FAF obtained by an air/fuel ratio feedback control routine (not shown), an air/fuel ratio learned value KG, and so forth.

A throttle valve 32 for adjusting the intake air flow rate GA is provided in the intake passage 20 to be located upstream of the surge tank 18. The throttle valve 32 is driven (opened and closed) by a throttle motor 34 provided in the intake passage 20, so that its opening amount, or throttle opening amount TA, is controlled as desired. A throttle sensor 36, which is located in the vicinity of the throttle valve 32, serves to detect the throttle opening amount TA, and generates a signal indicative of the throttle opening amount TA.

Also, an accelerator pedal 38 is provided in a driver compartment of the automobile, and an accelerator sensor 40 is provided for detecting the amount of depression of the accelerator pedal 38, or an accelerator operated amount PDLA. An electronic control unit (hereinafter referred to as "ECU") 50, which will be described later, controls the throttle motor 34 based on the accelerator operated amount PDLA and others inputs, to adjust the throttle opening amount TA depending upon the driving conditions of the vehicle. As will be described later, the throttle opening amount TA may be controlled so as to provide an output torque required for enabling steady-state running (equivalent to steady-state driving) as needed, without directly corresponding to or depending upon the accelerator operated amount PDLA.

A variable valve timing device (hereinafter abbreviated to "VVT") 52 permits an intake camshaft (not shown) having intake cams that determine the lift amount of intake valves, to be rotated relative to the engine crankshaft (not shown). The WT 52 is adapted to change the valve timing of the intake valves depending upon the operating conditions of the engine 4, so as to allow adjustment of valve overlap with exhaust valves. The valve timing is obtained based on the phase of rotation of the intake camshaft detected by a cam angle sensor 54.

An exhaust passage 62 is connected to each of the cylinders 8, 10, 12, 14 via an exhaust manifold 60. The exhaust passage 62 is provided with a catalytic converter 64 and a muffler 66. Exhaust gas that flows through the exhaust passage 62 passes through the catalytic converter 64 and the muffler 66, and is then discharged to the outside of the vehicle.

An air flow meter 68 is provided between the air cleaner 22 and the throttle valve 32 in the intake passage 20. The air flow meter 68 detects the flow rate GA of intake air that is introduced into the combustion chamber of each cylinder 8, 10, 12, 14, and generates a signal representing the intake air flow rate GA.

A cylinder head 6a of the engine 4 is provided with spark plugs 70, 72, 74, 76 corresponding to the respective cylinders 8, 10, 12, 14. The spark plugs 70, 72, 74, 76 are respectively accompanied by ignition coils 70*a*, 72*a*, 74*a*, 76*a*, to thus provide a direct ignition system that does not use a distributor. Each of the ignition coils 70*a*, 72*a*, 74*a*, 76*a* operates to apply a high voltage generated upon cut-off of primary-side current supplied from an ignition drive circuit within the ECU 50, directly to a corresponding one of the spark plugs 70, 72, 74, 76, in suitable ignition timing.

An oxygen sensor 80 is located upstream of the catalytic converter 64 within the exhaust passage 62. The oxygen sensor 80 generates a signal Vox indicative of the air/fuel ratio of air/fuel mixture which appears in components of exhaust. An air/fuel feedback control operation is performed based on the signal Vox, so that the air/fuel ratio is controlled to the stoichiometric air/fuel ratio, by increasing or reducing the quantity of fuel to be injected, using the air/fuel ratio feedback correction factor FAF, air/fuel ratio learned value KG, and others values.

An engine speed sensor 90 generates a pulse signal corresponding to the engine speed NE of the engine 4 based on the rotating speed of the crankshaft of the engine 4, and a cylinder identification sensor 92 generates a pulse signal as a reference signal for each specified crank angle during rotation of the crankshaft so as to identify each of the cylinders 8, 10, 12, 14. The ECU 50 calculates the engine speed NE and the crank angle, and also performs cylinder identification, based on the output signals from the engine speed sensor 90 and cylinder identification sensor 92.

A water temperature sensor 94 for detecting the engine coolant temperature, which is provided in the cylinder block 6, generates a signal indicative of the coolant temperature THW. A shift position sensor 96 is provided in a transmission that is not illustrated, and operates to generate a signal indicative of the shift position SHFTP. This transmission is an automatic transmission, and the shift position is controlled by the ECU 50.

A vehicle speed sensor 97 is provided on the output shaft of the transmission, and generates a signal indicative of the vehicle speed SPD.

Figure 2:
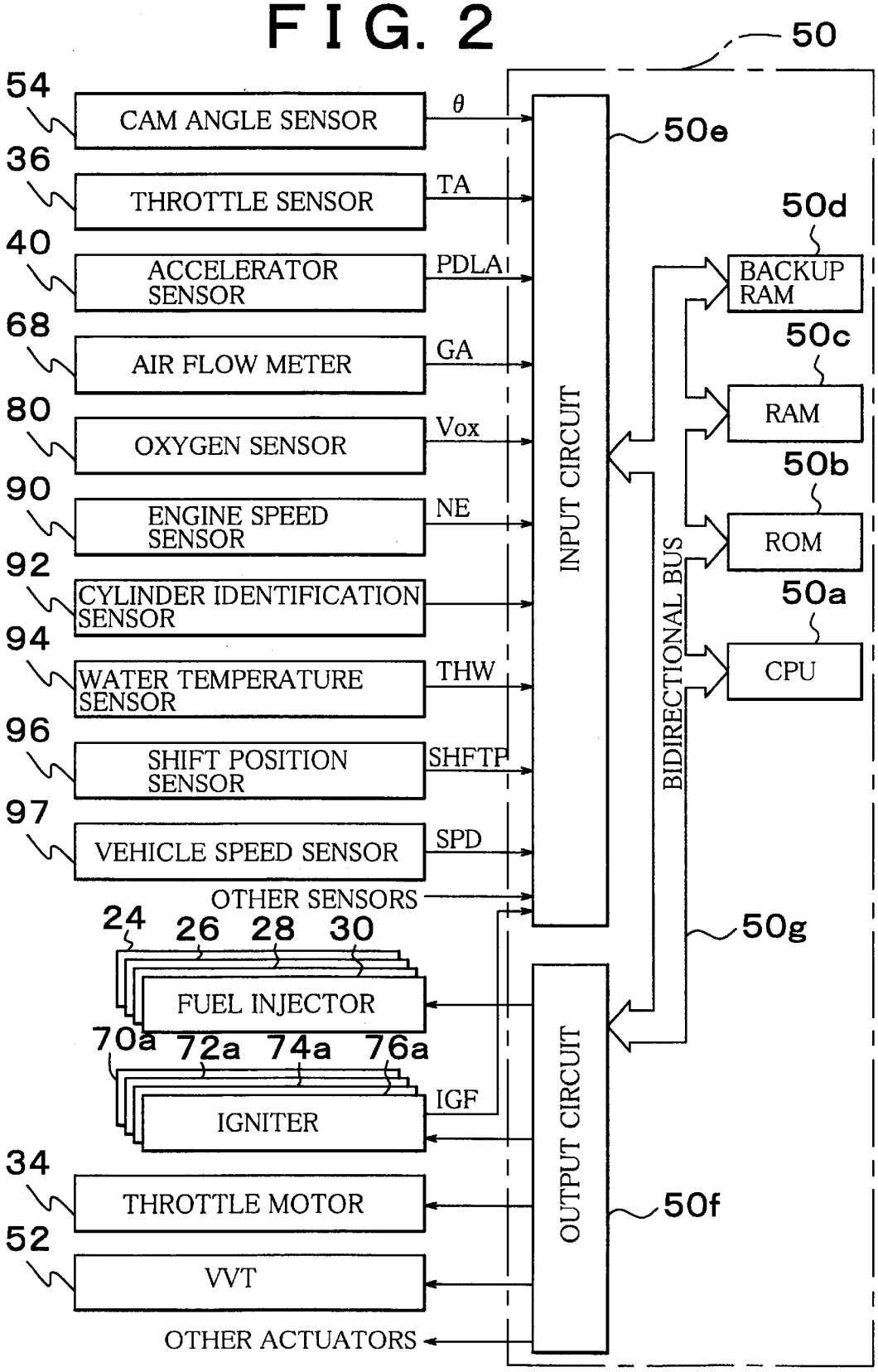
FIG. 2 is a block diagram showing the construction of the control system of the first embodiment of the invention.

Referring to the block diagram of FIG. 2, the construction of a throttle control apparatus of the first embodiment of the invention and a control system that performs other functions will be now described.

The ECU 50 includes a central processing unit (CPU) 50*a*, read only memory (ROM) 50*b*, random access memory (RAM) 50*c*, backup RAM 50*d*, and other components. The ECU 50 includes a logic unit or circuit in which the above-indicated components 50*a*–50*d* are connected to an input circuit 50*e*, an output circuit 50*f* and other components through a bidirectional bus 50*g*. The ROM 50*b* stores therein various control programs of, for example, a target throttle opening amount calculation control routine as described later, and various types of data, such as maps. The RAM 50*c* temporarily stores operation results of the CPU 50*a* obtained in various control operations, and other data.

The input circuit 50*e* service as an input interface, and includes a buffer, a waveform shaping circuit, an A/D converter, and others components. To the input circuit 50*e* are respectively connected the throttle sensor 36, accelerator sensor 40, cam angle sensor 54, air flow meter 68, oxygen sensor 80, engine speed sensor 90, cylinder identification sensor 92, water temperature sensor 94, shift position sensor 96, vehicle speed sensor 97, lines transmitting ignition confirmation signals IGf of the respective ignition coils 70*a*, 72*a*, 74*a*, 76*a*, etc. The output signals of the respective sensors are converted into digital signals, which are then transmitted through the bidirectional bus 50*g* and read into the CPU 50*a*.

The output circuit 50*f* includes various drive circuits, and the fuel injectors 24, 26, 28, 30, throttle motor 34, VVT 52, ignition coils 70*a*, 72*a*, 74*a*, 76*a*, and other components are connected to the output circuit 50*f*. The ECU 50 performs arithmetic operations based on the output signals from the respective sensors 36, 40, 54, 68, 80, 90, 92, 94, 96, 97, and controls the fuel injectors 24, 26, 28, 30, throttle motor 34, VVT 52, ignition coils 70*a*, 72*a*, 74*a*, 76*a*, etc.

For example, the ECU 50 calculates a load of the engine 4 based on the intake air flow rate GA detected by the air flow meter 68, and also controls the quantity and timing of fuel injection performed by the fuel injectors 24, 26, 28, 30, the valve timing of the VVT 52, and the ignition timing of the ignition coils 70*a*, 72*a*, 74*a*, 76*a*, depending upon the engine load and the engine speed NE. The ECU 50 then corrects the quantity of fuel to be injected by the fuel injectors 24, 26, 28, 30 by increasing or reducing it, based on the air/fuel ratio detected by the oxygen sensor 80, so as to accurately control the air/fuel ratio of the air/fuel mixture.

Figure 3A:
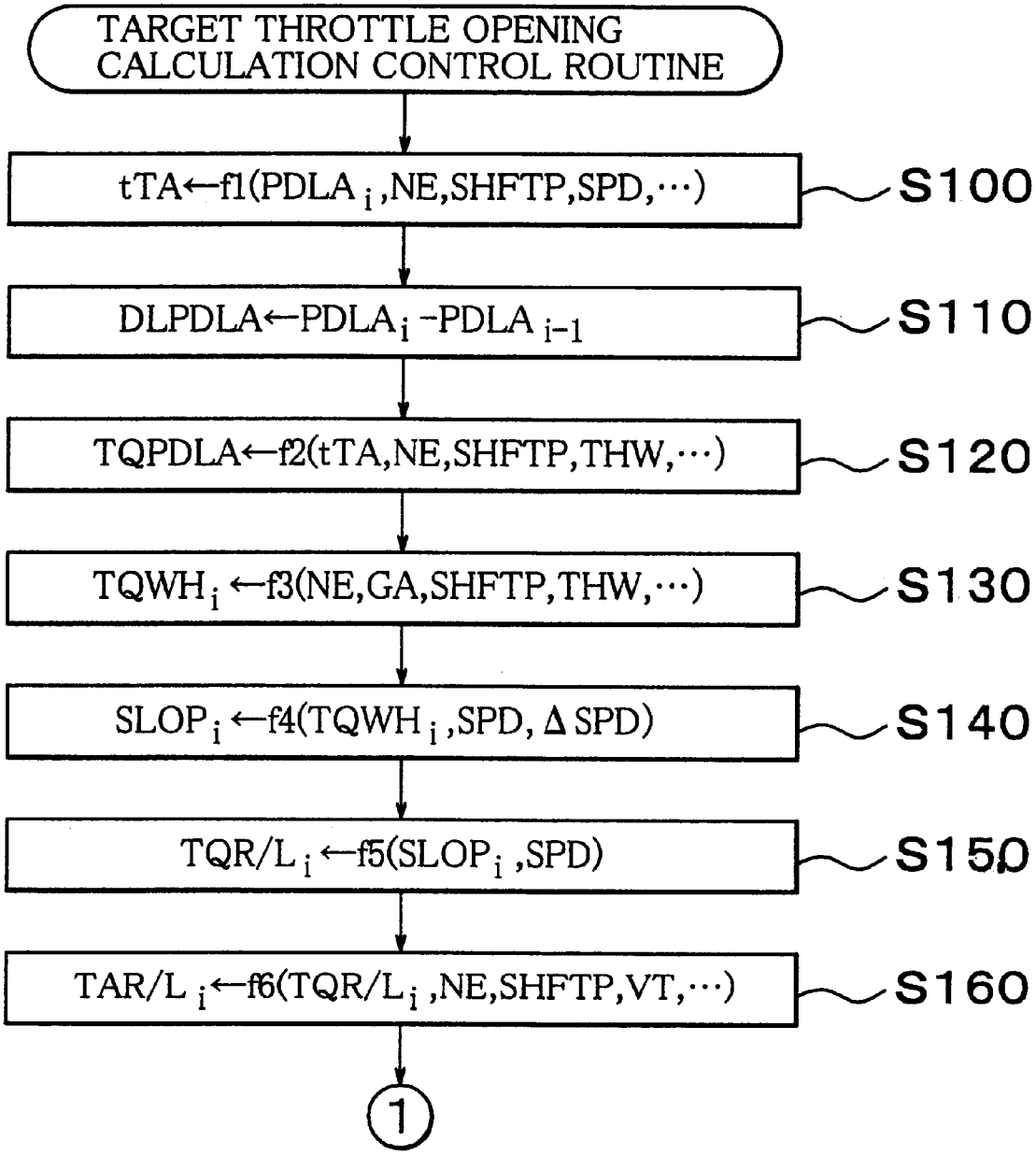
FIG. 3A, FIG. 3B and FIG. 3C are flowcharts of a target throttle opening amount calculation control routine according to the first embodiment of the invention.

Referring next to the flowcharts of FIG. 3A through FIG. 3C, a target throttle opening amount calculation control routine and its associated routines to be executed by the ECU 50 in the first embodiment will be described. It is to be noted that step numbers in a flowchart corresponding to each routine are denoted by "S~". The present routine is repeatedly executed at regular time intervals or on a cycle of a certain crank angle.

Upon the start of the target throttle opening amount calculation control routine, the accelerator operated amount (the amount of depression of the accelerator pedal) PDLAi, engine speed NE, shift position SHIFTP, and vehicle speed SPD respectively detected by the accelerator sensor 40, the engine speed sensor 90, the shift position sensor 96, and the vehicle speed sensor 97 are read in. Step S100 is then executed to calculate a tentative throttle opening amount tTA from a map f1 stored in the ROM 50*b*, based on these values PDLAi, NE, SHIFTP, SPD and others, as indicated by the following expression (1).

$$tTA \leftarrow f1\ (PDLAi,\ NE,\ SHITP,\ SPD\ \ldots) \qquad (1)$$

The tentative throttle opening amount tTA is defined as a throttle opening amount that depends upon the accelerator operated amount PDLAi. Here, "i" suffixed to PDLA represents a value detected in the current control cycle. Also, "i−1" used in the next expression (2) represents a value detected in the previous control cycle. Other parameters, such as a coolant temperature THW, may be added to the above-indicated parameters of the map f1.

Next, a change DLPDLA in the accelerator operated amount PDLA is obtained in step S110 by subtracting the accelerator operated amount PDLA(i−1) detected in the previous control cycle from the accelerator operated amount PDLA detected in the current control cycle, according to the following expression (2).

$$DLPDLA \leftarrow PDLAi - PDLA(i-1) \quad (2)$$

In the next step S120, a demanded output torque TQPDLA that is demanded by the driver is obtained from a map f2 stored in the ROM 50*b*, based on the tentative throttle opening amount tTA, engine speed NE, shift position SHFTP, coolant temperature THW and others, as indicated by the following expression (3).

$$TQPDLA < f2\ (tTA, NE, SHFTP, THW \ldots) \quad (3)$$

In the next step S130, a current actual output torque TQWHi is obtained from a map f3 stored in the ROM 50*b*, based on the intake air flow rate GA detected by the air flow meter 68, engine speed NE, shift position SHFTP, coolant temperature THW and others, as indicated by the following expression (4).

$$TQWHi \leftarrow f3\ (NE, GA, SHFTP, THW \ldots) \quad (4)$$

In the next step S140, a current road slope SLOPi is obtained from a map f4 stored in the ROM 50*b*, based on the actual output torque TQWHi, vehicle speed SPD and a change SPD in the vehicle speed SPD, as indicated by the following expression (5).

$$SLOPi \leftarrow f4\ (TQWHi, \Delta SPD, SPD) \quad (5)$$

In the next step S150, an output torque required for maintaining the current vehicle speed SPD is obtained as a steady-state required torque TQR/Li, from a map f5 stored in the ROM 50*b*, based on the current road slope SLOPi and the vehicle speed SPD, as indicated by the following expression (6).

$$TQR/Li \leftarrow f5\ (SLOPi, SPD) \quad (6)$$

In the next step S160, a throttle opening amount needed for providing the steady-state required torque TQR/Li obtained in step S150 is obtained as a steady-state required throttle opening amount TAR/Li. More specifically, the current steady-state required throttle opening amount TAR/Li is obtained from a map f6 stored in the ROM 50*b*, based on the steady-state required torque TQR/Li, engine speed NE, shift position SHFTP, valve timing VT and others, as indicated by the following expression (7).

$$TAR/Li \leftarrow f6\ (TQR/Li, NE, SHFTP, VT, \ldots) \quad (7)$$

Figure 3B:
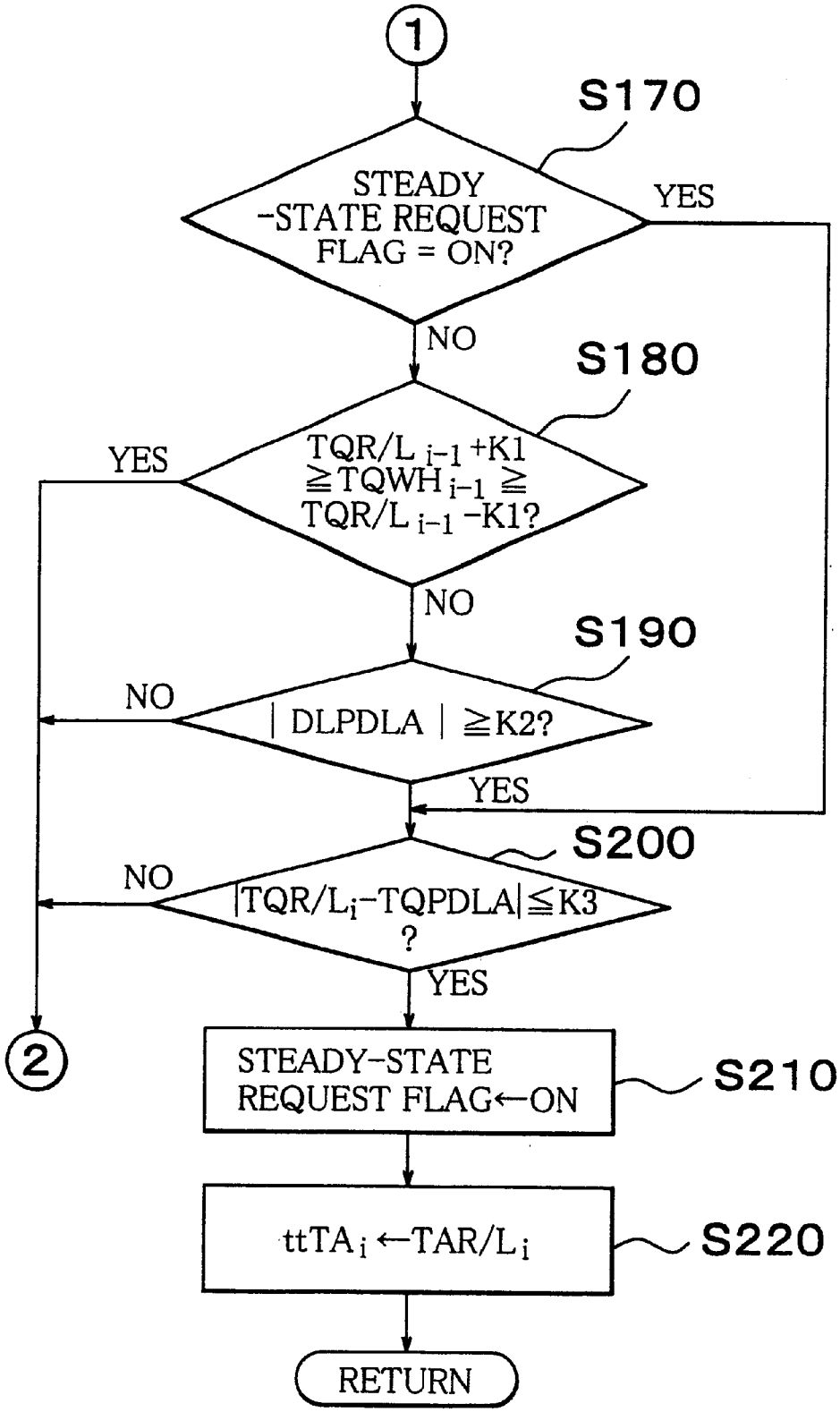

Referring next to FIG. 3B, step S170 is executed to determine whether a steady-state request flag set in the RAM 50*c* is "ON". This steady-state request flag is in the "ON" state when the driver requests or desires steady-state running of the vehicle.

If step S170 determines that steady-state running is not desired by the driver, namely, if the steady-state request flag is "OFF" ("NO" in step S170), step S180 is executed to determine whether the actual output torque TQWH(i−1) obtained in the previous control cycle satisfies a condition as represented by the expression (8) as follows:

$$TQR/L(i-1)+K1 \geqq TQWH(i-1) \geqq TQR/L(i-1)-K1 \quad (8)$$

where K1 is a positive correction value, and "TQR/L(i−1)" is the steady-state required torque obtained in the previous control cycle. The above-indicated expression (8) is used to determine whether the actual output torque TQWH(i−1) is substantially equivalent to the steady-state required torque TQR/L(i−1), thereby to determine whether the driving state of the engine was not an accelerating state or a decelerating state in the previous control cycle.

If the above-indicated expression (8) is not satisfied ("N" is obtained in step S180), namely, if the engine was accelerating or decelerating in the previous control cycle, step S190 is executed to determine whether the absolute value |DLPDLA| of the change DLPDLA in the accelerator operated amount PDLA obtained in step S110 is equal to or larger than a criterial value K2 (>0) or not. Namely, it is determined whether the driver has largely changed the position of the accelerator pedal 38.

If |DLPDLA| is equal to or larger than K2 ("YES" in step S190), step S200 is executed to determine whether the relationship between the steady-state required torque TQR/Li and the demanded output torque TQPDLA satisfies the following expression (9).

$$|TQR/Li - TQPDLA| \leqq K3 \quad (9)$$

Here, the criterial value K3 (>0) is such a small value so as to indicate whether the steady-state required torque TQR/Li and the demanded output torque TQPDLA are sufficiently close to each other. If the above expression (9) is satisfied, it can be determined that the steady-state required torque TQR/Li and the demanded output torque TQPDLA are sufficiently close to each other.

If the above-indicated expression (9) is satisfied ("YES" is obtained in step S200), step S210 is executed to set the steady-state request flag to "ON". Thus, the judgements in the above-described steps S180, S190, S200 are made so as to determine whether steady-state running is desired by the driver.

If steady-state running is desired or requested by the driver, step 220 is executed to set the current steady-state required throttle opening amount TAR/Li obtained in step S160, as a target throttle opening amount ttTAi of the current control cycle. In this manner, the current cycle of the target throttle opening amount calculation control routine is finished, and a main routine including a fuel injection operation and others is executed.

Since the steady-state request flag is set to "ON" in the next control cycle ("YES" is obtained in step S170), the control flow proceeds to step S200, to determine whether the above-indicated expression (9) is satisfied.

As long as the demanded output torque TQPDLA is sufficiently close to the steady-state required torque ("YES" is obtained in step S200), the steady-state request flag is kept in the "ON" state in step S210. In step S220, therefore, the steady-state required throttle opening amount TAR/Li obtained in step S160 in the current driving conditions is used as a target throttle opening amount ttTAi.

Figure 3C:
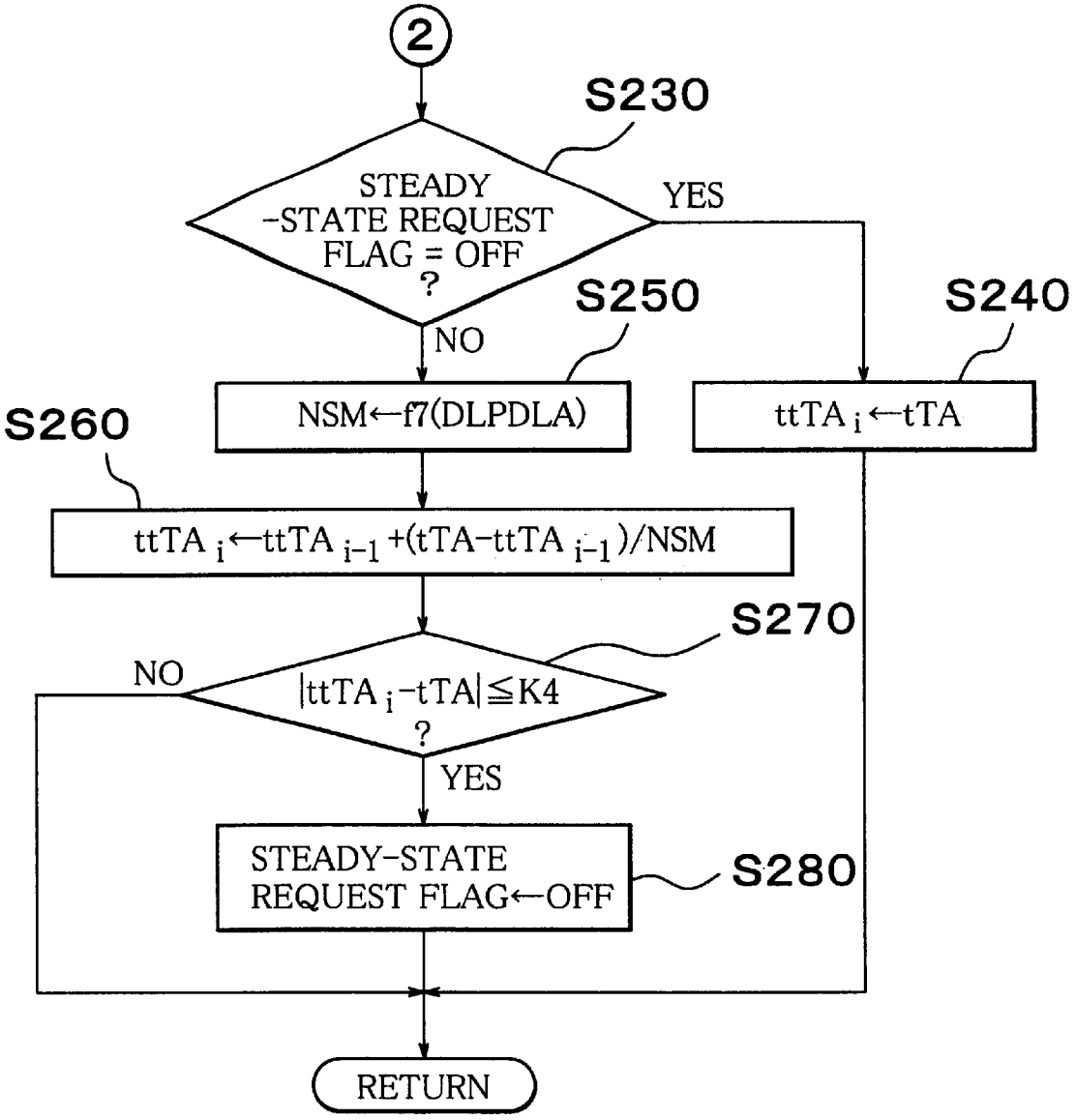

In the case where the above-indicated expression (8) is satisfied ("YES" in step S180) with no acceleration nor deceleration occurring in the previous control cycle when the steady-state request flag is set to "OFF" ("NO" in step S170), the control flow proceeds to step S230 of FIG. 3C. Also, if the accelerator operated amount does not experience a large change, and |DLPDLA| is smaller than K2 ("NO" in step S190), the control flow proceeds to step S230 of FIG. 3C.

In step S230, it is determined whether the steady-state request flag is set to "OFF". Since the steady-state request flag is set to "OFF" in this case ("YES" in step S230), which means that the driver is not desiring or demanding steady-state running of the vehicle, step S240 is executed to set the tentative throttle opening amount tTA obtained in step S100 as a target throttle opening amount ttTAi of the current control cycle. After execution of step S240, the target throttle opening amount calculation control routine is once finished, and the main routine including the fuel injection operation and others is executed.

Where the demanded output torque TQPDLA deviates from the steady-state required torque TQR/Li while the steady-state request flag is set to "ON" ("NO" in step S200), namely, if an accelerating or decelerating action performed by the driver indicates that steady-state running is no longer desired, the control flow proceeds to step S230 of FIG. 3C.

Since step S230 determines that the steady-state request flag is set to "ON" in this case ("NO" is obtained in step S230), step S250 is then executed to obtain the time constant NSM for weighted means calculation (calculation of a weighted mean value). The time constant NSM is obtained from a map f7 stored in the ROM 50*b*, based on the change DLPDLA in the accelerator operated amount PDLA, as indicated by the following expression (10).

$$NSM \leftarrow f7\ (DLPDLA) \tag{10}$$

Using the time constant NSM obtained in the above manner, a target throttle opening amount ttTAi of the current control cycle is obtained in step S260 based on the target throttle opening amount ttTA(i−1) in the previous control cycle and the tentative throttle opening amount tTA obtained in step S100, through weighted mean calculation as indicated by the following expression (11).

$$ttTAi \leftarrow ttTA(i-1)+(tTA-ttTA(i-1))/NSM \tag{11}$$

Step S270 is then executed to determine whether the relationship between the tentative throttle opening amount tTA and the target throttle opening amount ttTAi satisfies the following expression (12).

$$|ttTAi-tTA| \leq K4 \tag{12}$$

Here, the criterial value K4 (>0) is such a small value so as to indicate that the tentative throttle opening amount tTA and the target throttle opening amount ttTAi are sufficiently close to each other, i.e., a difference between tTA and ttTAi is sufficiently small. If the above-indicated expression (12) is satisfied, it is determined that the tentative throttle opening amount tTA and the target throttle opening amount ttTAi are sufficiently close to each other.

If the tentative throttle opening amount tTA and the target throttle opening amount ttTAi are not sufficiently close to each other, i.e., a difference between tTA and ttTAi is not sufficiently reduced ("NO" in step S270), the current cycle of the routine is finished, and the main routine including the fuel injection operation and others is executed.

Where the steady-state request flag is set to "ON" ("YES" in step S170), and the driver is operating the accelerator pedal 38 for acceleration or deceleration of the vehicle ("NO" in step S200), therefore, the target throttle opening amount ttTAi gradually approaches the tentative throttle opening amount tTA by repeated calculation of the above-indicated expression (11).

If the above-indicated expression (12) is satisfied ("YES" in step S270), the steady-state request flag is set to "OFF" in step S280, and the current cycle of the routine is finished, followed by the main routine including the fuel injection operation and others.

The ECU 50 operates to drive the throttle motor 34 based on the target throttle opening amount ttTAi determined as described above, so that the throttle opening amount TA detected by the throttle sensor 36 matches the target throttle opening amount ttTAi.

One example of control according to the target throttle opening amount calculation control routine as described above is illustrated in the timing charts of FIG. 4A~FIG. 4D and FIG. 5A~FIG. 5D.

Figures 4A, 4B, 4C, 4D:
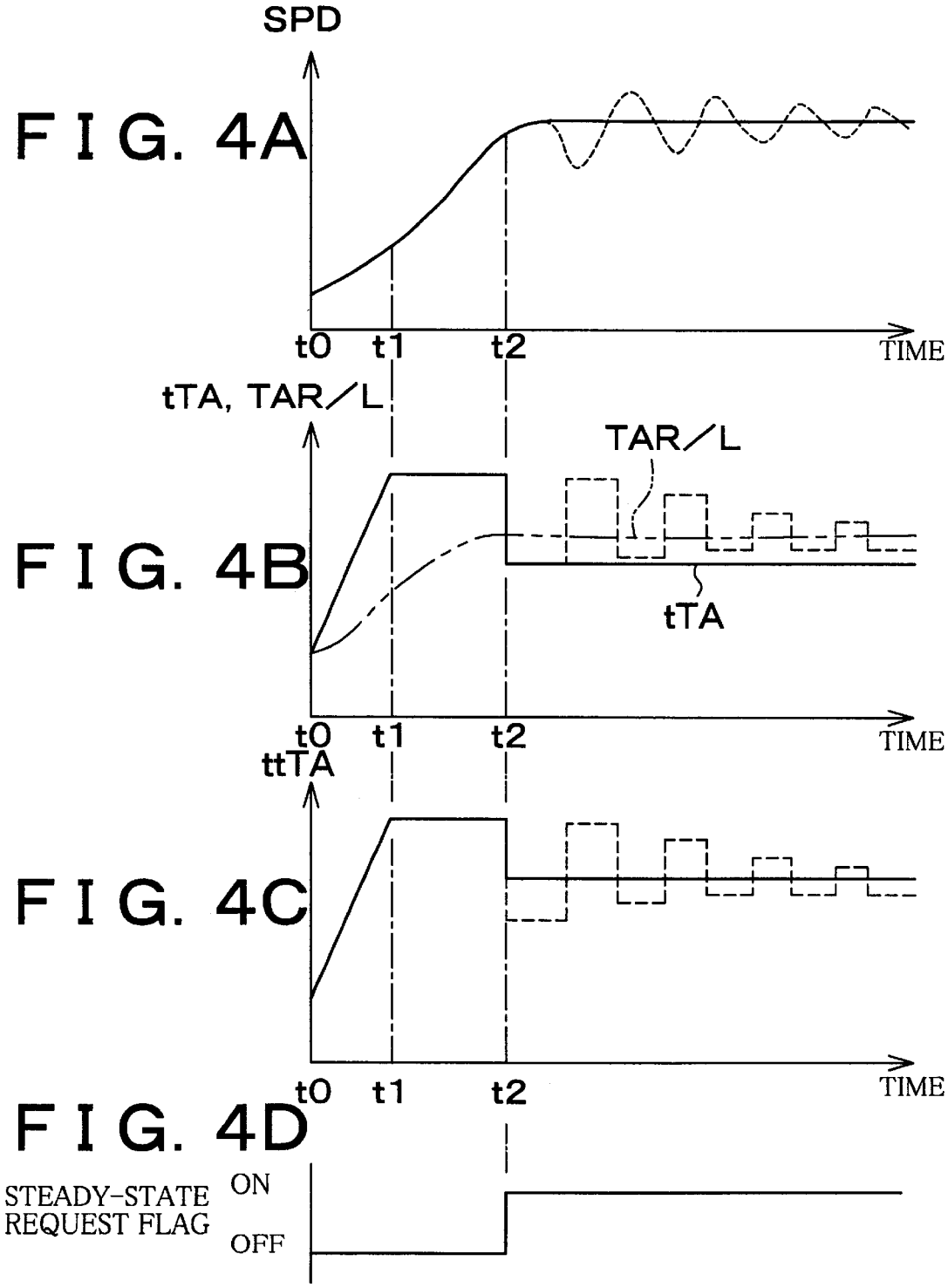
FIG. 4A through FIG. 4D are timing charts showing one example of control according to the first embodiment of the invention.

Suppose that the driver presses down the accelerator pedal 38 at a point in time t0 so as to accelerate the automobile that has been in a steady-state running state. Since the accelerator operated amount PDLA is rapidly increased at this point in time, the tentative throttle opening amount tTA obtained in step S100 also rapidly increases as shown in FIG. 4B. At the same time, the steady-state required throttle opening amount TAR/L obtained in the process of steps S130~S160 gradually changes, i.e., increases in this case, as shown in FIG. 4B, due to increases in the vehicle speed SPD and engine speed NE, an increase in the intake air flow rate GA, changes in the shift position SHFTP and valve timing VT, and other factors.

With the rapid increase in the tentative throttle opening amount tTA, the relationship of the above-indicated expression (9) is no longer satisfied in step S200 ("NO" is obtained in step S200). Since the steady-state request flag is still set to"ON" at time t0 ("NO" in step S230), steps S250~S270 are executed. If the tentative throttle opening amount tTA is already close to the target throttle opening amount ttTAi ("YES" is obtained in step S270) at this point in time, the steady-state request flag is set to"OFF" in step S280.

In the next and subsequent control cycles, therefore, an affirmative decision"YES" is obtained in step S230, and the tentative throttle opening amount tTA is set to the target throttle opening amount ttTAi in step S240. Thus, the target throttle opening amount ttTAi rapidly increases in accordance with the accelerator operated amount PDLA, as shown in FIG. 4C.

Upon and after a point in time t1, the vehicle speed SPD continues increasing while the driver keeps the accelerator pedal 38 depressed.

At a point in time t2 at which the vehicle speed SPD almost reaches a desired level, the driver allows the accelerator pedal 38 to return by a large degree so as to inhibit a further increase in the vehicle speed SPD. By this point in time t2, a large difference exists between the steady-state required torque TQR/L and the actual output torque TQWH in the previous control cycle, due to a rapid increase in the actual output torque TQWH ("NO" in step S180). At time t2, the change DLPDLA in the accelerator operated amount PDLA becomes large as shown in FIG. 4B. ("YES" in step S190). As a result of further returning the accelerator pedal 38 or reducing the accelerator operated amount PDLA so as to stabilize the vehicle speed SPD, the demanded output torque TQPDLA calculated based on the tentative throttle opening amount tTA approaches the steady-state required torque TQR/L ("YES" in step 200). As a result, step S210 is executed so that the steady-state request flag is set to"ON".

As shown in FIG. 4C, therefore, the target throttle opening amount ttTA is set to the tentative throttle opening amount tTA (step S240) until time t2 is reached, and the throttle opening amount is controlled depending upon the accelerator operated amount PDLA. From time t2 on, however, the steady-state required throttle opening amount TAR/L is set to the target throttle opening amount ttTA (step S220).

Figures 5A, 5B, 5C, 5D:
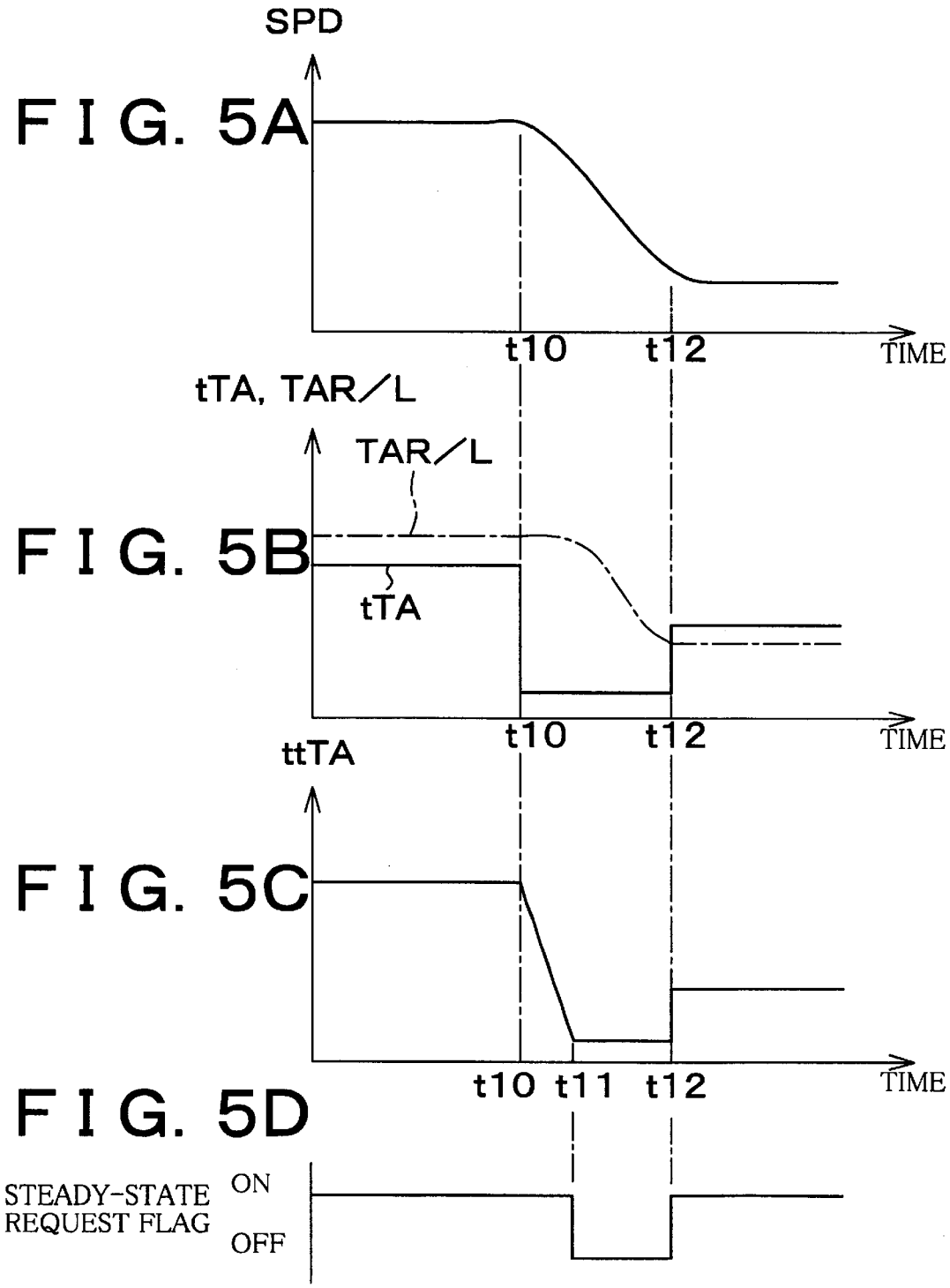
FIG. 5A through FIG. 5D are timing charts showing another example of control according to the first embodiment of the invention.

At a point in time t10, the driver returns or releases the accelerator pedal 38 so as to reduce the vehicle speed of the automobile, as shown in FIG. 5A~FIG. 5D. The accelerator operated amount PDLA is rapidly reduced at this time, and therefore the tentative throttle opening amount tTA obtained in step S100 also rapidly falls as shown in FIG. 5B. At the same time, the steady-state required throttle opening amount TAR/L obtained in the process of steps S130~S160 is gradually reduced as shown in FIG. 5B, due to reductions in the vehicle speed SPD and the engine speed NE, a reduction in the intake air flow rate GA, changes in the shift position SHFTP and valve timing VT, and other factors.

With the rapid reduction in the tentative throttle opening amount tTA, the relationship of the above-indicated expression (9) is no longer satisfied ("NO" is obtained in step S200). The steady-state request flag is set to "ON" ("NO" in step S230) at this point in time t10, and therefore steps S250 to S270 are executed. Since the tentative throttle opening amount tTA and the target throttle opening amount ttTAi differ largely from each other at this time ("NO" in step S270), step S280 is not executed. Namely, the steady-state request flag is not immediately set to "OFF".

With the above arrangement, the target throttle opening amount ttTAi is gradually reduced by repeatedly executing step S260 to update ttTAi according to the above-indicated expression (11) until the target throttle opening amount ttTAi sufficiently approaches the tentative throttle opening amount tTA. In the meantime, the above-indicated expression (12) is not satisfied for a while ("NO" in step S270). Thus, the steady-state request flag is kept in the"ON" state.

When the target throttle opening amount ttTAi becomes sufficiently close to the tentative throttle opening amount tTA (time t11), and the above-indicated expression (12) is satisfied ("YES" in step S270), the steady-state request flag is set to "OFF" in step S280.

In the next and subsequent control cycles, therefore, an affirmative decision "YES" is obtained in step S230, and the tentative throttle opening amount tTA is set to the target throttle opening amount ttTAi in step S240. Accordingly, the target throttle opening amount ttTAi corresponds to the accelerator operated amount PDLA after time t11 is reached.

Upon and after time t11, the vehicle speed SPD continues to be lowered while the driver keeps the accelerator pedal returned.

At a point in time t12 when the vehicle speed SPD almost reaches a desired level, the driver depresses the accelerator pedal 38 by a larger degree than that during steady-state running, so as to inhibit a further reduction in the vehicle speed SPD. By this point in time t12, a large difference exists between the steady-state required torque TQR/L and the actual output torque TQWH in the previous control cycle due to a rapid reduction in the actual output torque TQWH ("NO" in step S180). At the point in time t12, the change DLPDLA in the accelerator operated amount PDLA becomes large as shown in FIG. 5B. ("YES" in step S190). As a result of further increasing the accelerator operated amount PDLA so as to stabilize the vehicle speed SPD, the demanded output torque TQPDLA calculated based on the tentative throttle opening amount tTA approaches the steady-state required torque TQR/L ("YES" in step S200). As a result, step S210 is executed so that the steady-state request flag is set to "ON".

As shown in FIG. 5C, therefore, the target throttle opening amount ttTA is set to the tentative throttle opening amount tTA (step S240) until time t12 is reached, and the throttle opening amount is controlled depending upon the accelerator operated amount PDLA, as shown in FIG. 5C. From time t12 on, however, the steady-state required throttle opening amount TAR/L is set to the target throttle opening amount ttTA (step S220).

In the first embodiment as described above, the vehicle speed SPD and the road slope SLOP on which the automobile is running are equivalent to the running conditions of the driven mechanism, and the vehicle speed sensor 97 and step S140 function as a detector for detecting the running conditions of the driven mechanism.

Also, step S150 functions as a steady-state required torque calculator, and steps S180, S190 and S200 function to detect an operation that leads to steady-state running of the driven mechanism, while steps S160 and S220 function to control the throttle opening amount in a steady-state running mode.

Also, step S200 functions to switch over to throttle control in a non-steady-state running mode, and steps S230 to S280 function to update a target throttle opening amount.

The first embodiment of the present invention as described above provides advantageous effects as described below.

(1) When a negative decision "NO" is obtained in step S180, an affirmative decision "YES" is obtained in step S190, and an affirmative decision "YES" is obtained in step S200, an operation performed on the engine 4 can be determined as a request or demand for steady-state running of the automobile. If the request for steady-state running is recognized, the target throttle opening amount ttTA is set in step S220 so as to provide the steady-state required torque TQR/L calculated so that the automobile is brought into a steady-state running mode, instead of setting the target throttle opening amount ttTA depending upon the accelerator operated amount PDLA (step S240).

Where the engine 4 is operated so that the automobile proceeds to steady-state running, the target throttle opening amount ttTA does not directly depend upon the accelerator operated amount PDLA, but the throttle opening amount is controlled so as to provide the steady-state required torque TQR/L. Accordingly, where the controller (ECU) determines an accelerator operation by the driver as an intention or demand to let the vehicle proceed to steady-state running, the target throttle opening amount ttTA is set independent of the accelerator operated amount PDLA, and the throttle opening amount is controlled so as to provide the steady-state required torque TQR/L. Thus, the throttle opening amount no longer changes rapidly depending upon the accelerator operated amount PDLA.

With the above arrangement, the driving mode of the automobile immediately shifts to a desired steady-state running mode, and any accelerator operation is not directly reflected by the throttle opening amount, thus eliminating a need for the driver to repeatedly operate the accelerator pedal. In a conventional control method, the driver needs to operate the accelerator pedal or adjust the accelerator pedal position for a relatively long time so that the vehicle speed converges at a desired level, as indicated by broken lines in FIG. 4A through FIG. 4C. In the illustrated embodiment, on the other hand, the target throttle opening amount ttTA can be immediately set to a value that corresponds to an output torque required for steady-state running (steady-state required torque TQR/L), and the vehicle speed can be immediately stabilized, so that the automobile enters a steady-state running mode. In addition, the operations of the accelerator pedal 38 by the driver are only indirectly reflected by the target throttle opening amount ttTA. This eliminates the need for the driver to repeatedly operate the accelerator pedal, thus assuring improved driveability.

(2) In particular, the presence of a request or demand for steady-state running is judged from the facts that a large difference existed between the actual output torque TQWH and the steady-state required torque TQR/L at a point immediately before the current cycle ("NO" in step S180), that the change DLPDLA in the accelerator operated amount PDLA is larger than a certain value ("YES" in step S190), and that a difference between the demanded output torque TQPDLA and the steady-state required torque TQR/L is sufficiently reduced ("YES" in step S200).

By making the judgement in the above manner, an operation to proceed to steady-state running can be detected with higher accuracy, thus permitting more accurate control.

(3) Where a difference between the demanded output torque TQPDLA and the steady-state required torque TQR/L becomes larger than a certain value ("NO" in step S200), the controller (ECU) determines that steady-state running is finished. If steady-state running is thus finished, the vehicle is brought into a non-steady-state running mode in which the target throttle opening amount ttTA is set depending upon the accelerator operated amount PDLA (S240).

In the above manner, the driver can operate the accelerator pedal to let the automobile out of a steady-state running mode, thereby to accelerate or decelerate the automobile with high response. This makes it possible to maintain good driveability during acceleration or deceleration of the automobile.

(4) When the automobile comes out of a steady-state running mode, the target throttle opening amount ttTA is gradually changed from the one to which the steady-state required throttle opening amount TAR/L has been set so as to provide the steady-state required torque TQR/L, to the one that depends upon or varies with the accelerator operated amount PDLA (S230~S280). This makes it possible to suppress shocks due to variations in the output torque upon switching of control, thus assuring further improved driveability.

In the illustrated embodiment, the presence of a driver's request or demand for steady-state running is judged from the facts that the automobile was in an accelerating or decelerating state in the previous control cycle ("NO" in step S180), that the change DLPDLA in the accelerator operated amount PDLA is larger than the criterial value K2 ("YES" in step S190), and that the demanded output torque TQPDLA is sufficiently close to the steady-state required torque TQR/Li ("YES" in step S200). The above judgment may be made even if all of these three conditions are not satisfied, for example, by omitting the determination of step S180 and only making the determinations of step S190 and step S200. Also, the presence of a request for steady-state running may be judged by executing only step S180 and step S200, or executing only step S200.

In the illustrated embodiment, the controller (ECU 50) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller also can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the flowcharts shown in FIGS. 3A–3C can be used as the controller. A distributed processing architecture can be used for maximum data/signal processing capability and speed.

While the invention has been described with reference to preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A throttle control apparatus of an internal combustion engine, comprising a throttle controller that:

detects running conditions of a driven mechanism that is driven by the engine;

calculates a steady-state required torque based on the detected running conditions of the driven mechanism, the steady-state required torque being required to bring the driven mechanism into a steady-state running mode;

calculates a demanded output torque based on an operation performed on the engine;

determines that the operation performed on the engine causes the driven mechanism to proceed to a steady-state running mode under a first condition in which a difference between the calculated demanded output torque and the calculated steady-state required torque is equal to or smaller than a first predetermined value; and controls a throttle valve of the engine so that an output torque of the engine matches the calculated steady-state required torque when it is determined that the operation performed on the engine causes the driven mechanism to proceed to the steady-state running mode.

2. A throttle control apparatus according to claim 1, wherein the controller also:

calculates a change in an amount of the operation performed on the engine; and the controller determines that the operation performed on the engine causes the driven mechanism to proceed to a steady-state running mode under a second condition in which the calculated change in the amount of the operation performed on the engine is larger than a second predetermined value, in addition to said first condition.

3. A throttle control apparatus according to claim 2, wherein the controller determines that the operation performed on the engine causes the driven mechanism to proceed to a steady-state running mode under a third condition in which the driven mechanism was in an accelerating or decelerating state at a point in time immediately before a current control cycle, in addition to said first condition and said second condition.

4. A throttle control apparatus according to claim 3, wherein the controller determines that the driven mechanism was in an accelerating or decelerating state at the point in time immediately before the current control cycle when a difference between the output torque of the engine and the calculated steady-state required torque was equal to or larger than a third predetermined value at the point in time immediately before the current control cycle.

5. A throttle control apparatus according to defined in claim 4, wherein the controller also:

determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

6. A throttle control apparatus according to claim 5, wherein the controller:

gradually changes a target throttle opening amount from an amount that provides the steady-state required torque, to a target throttle opening amount that depends upon the accelerator operated amount, when the driven mechanism shifts from the steady-state running mode to a non-steady-state running mode.

7. A throttle control apparatus according to claim 4, wherein the controller:

gradually changes a target throttle opening amount from an amount that provides the steady-state required torque, to a target throttle opening amount that depends upon the accelerator operated amount, when the driven mechanism shifts from the steady-state running mode to a non-steady-state running mode.

8. A throttle control apparatus according to claim 3, wherein the controller also:

determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

9. A throttle control apparatus according to claim 8, wherein the controller:

gradually changes a target throttle opening amount from an amount that provides the steady-state required torque, to a target throttle opening amount that depends upon the accelerator operated amount, when the driven mechanism shifts from the steady-state running mode to a non-steady-state running mode.

10. A throttle control apparatus according to claim 6, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

11. A throttle control apparatus according to claim 2, wherein the controller also:

determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

12. A throttle control apparatus according to claim 11, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

13. A throttle control apparatus according to claim 2, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

14. A throttle control apparatus according to claim 1, wherein the controller determines that the operation performed on the engine causes the driven mechanism to proceed to a steady-state running mode under a condition in which the driven mechanism was in an accelerating or decelerating state at a point in time immediately before a current control cycle, in addition to said first condition.

15. A throttle control apparatus according to claim 14, wherein the controller determines that the driven mechanism was in the accelerating or decelerating state at the point in time immediately before the current control cycle when a difference between the output torque of the engine and the calculated steady-state required torque was equal to or larger than a third predetermined value at the point in time immediately before the current control cycle.

16. A throttle control apparatus according to claim 15, wherein the controller also:

determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

17. A throttle control apparatus according to claim 16, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

18. A throttle control apparatus according to claim 15, wherein the controller:

gradually changes a target throttle opening amount from an amount that provides the steady-state required torque, to a target throttle opening amount that depends upon the accelerator operated amount, when the driven mechanism shifts from the steady-state running mode to a non-steady-state running mode.

19. A throttle control apparatus according to claim 14, wherein the controller also:

determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

20. A throttle control apparatus according to claim 19, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

21. A throttle control apparatus according to claim 14, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

22. A throttle control apparatus according to claim 5, wherein the controller also:

determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

23. A throttle control apparatus according to claim 22, wherein the controller gradually changes the target throttle opening amount from an amount that provides the steady-state required torque, to a target throttle opening amount that depends upon the accelerator operated amount, when the driven mechanism shifts from the steady-state running mode to a non-steady-state running mode.

24. A throttle control apparatus according to claim 1, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

25. A throttle control apparatus of an internal combustion engine, comprising a throttle controller that:

detects running conditions of a driven mechanism that is driven by the engine;

calculates a steady-state required torque based on the detected running conditions of the driven mechanism, the steady-state required torque being required to bring the driven mechanism into a steady-state running mode;

determines whether an operation performed on the engine causes the driven mechanism to proceed to the steady-state running mode;

controls a throttle valve of the engine so that an output torque of the engine matches the calculated steady-state required torque when it is determined that the operation performed on the engine causes the driven mechanism to proceed to the steady-state running mode; and determines that the engine is operated so as to release the driven mechanism from the steady-state running mode when a difference between the demanded output torque calculated based on the operation performed on the engine and the calculated steady-state required torque is larger than said first predetermined value, and switches over to throttle control under which the throttle opening amount is controlled to a target throttle opening amount that depends upon an accelerator operated amount.

26. A throttle control apparatus according to claim 25, wherein the controller:

gradually changes the target throttle opening amount from an amount that provides the steady-state required torque, to a target throttle opening amount that depends upon the accelerator operated amount, when the driven mechanism shifts from the steady-state running mode to a non-steady-state running mode.

27. A throttle control method of an internal combustion engine, comprising:

detecting running conditions of a driven mechanism that is driven by the engine;

calculating a steady-state required torque based on the detected running conditions of the driven mechanism, the steady-state required torque being required to bring the driven mechanism into a steady-state running mode;

calculating a demanded output torque based on an operation performed on the engine;

determining that the operation performed on the engine causes the driven mechanism to proceed to a steady-state running mode under a first condition in which a difference between the calculated demanded output torque and the calculated steady-state required torque is equal to or smaller than a first predetermined value; and controlling a throttle valve so that an output torque of the engine matches the calculated steady-state required torque when it is determined that the operation performed on the engine causes the driven mechanism to proceed to the steady-state running mode.

* * * * *